United States Patent [19]

Pavoz

[11] Patent Number: 4,949,815

[45] Date of Patent: Aug. 21, 1990

[54] SHEAVE ARRAY OF A SELF PROPELLED ELEVATOR USING A LINEAR MOTOR ON THE COUNTERWEIGHT

[75] Inventor: Marcel Pavoz, Nanteere, France

[73] Assignee: Otis Elevator Company, Farmington, Conn.

[21] Appl. No.: 363,001

[22] Filed: Jun. 8, 1989

[51] Int. Cl.[5] ..... B66B 11/04

[52] U.S. Cl. ..... 187/20; 182/94

[58] Field of Search ..... 187/20, 23, 94, 9 R, 187/9 E, 1 R; 414/630, 631; 182/141

[56] References Cited

U.S. PATENT DOCUMENTS 3,845,842 11/1974 Johnson ..... 187/94

4,402,386 9/1983 Ficheax et al. ..... 187/29 R 4,496,031 1/1985 Allen et al. ..... 187/9 R

*Primary Examiner*—Joseph J. Rolla

*Assistant Examiner*—Kenneth Noland

*Attorney, Agent, or Firm*—William W. Jones

[57] ABSTRACT

Movement of the elevator is derived from a linear motor forming a part of the counterweight assembly of the elevator. Overhead guide sheaves carry the ropes which connect the counterweight with the cab. The guide sheaves are mounted laterally of the cab on both sides thereof whereby there are no sheaves directly above and in line with the cab. The cab mount beam connects to the center of gravity of the cab but lies skew to the lateral vertical plane of symmetry of the cab so that the ropes will be offset fore and aft of the guide rails of the cab.

9 Claims, 2 Drawing Sheets

SHEAVE ARRAY OF A SELF PROPELLED ELEVATOR USING A LINEAR MOTOR ON THE COUNTERWEIGHT

TECHNICAL FIELD

This invention relates to an elevator assembly having an overhead sheave arrangement where none of the sheaves is aligned with the elevator cab. More particularly. this invention relates to such an elevator assembly which derives its motive power from a linear motor mounted on the counterweight assembly of the elevator.

BACKGROUND ART

U.S. Pat. No. 4,402,386 describes an elevator assembly which is powered by a linear motor mounted on the counterweight of the elevator. The armature of the motor is a pole fixed in the elevator hoistway. The sheaves which carry the ropes connecting the counterweight and elevator cab are not traction sheaves, but are merely guide sheaves. Thus, the sheaves in the aforesaid elevator system are not connected to a drive motor, and there is no need to have a machine room, either overhead, or below the cab.

In some areas of the world, safety codes require that overhead sheaves not be installed in the hoistway directly above the roof of the cab. Compliance with these codes results in a very complex roping arrangement, typically requiring two sheaves mounted on the cab frame below the floor of the cab, and wherein a 2/1 roping ratio is used. This arrangement is complicated and costly as it requires extra sheaves and an excess of rope.

DISCLOSURE OF INVENTION

This invention relates to a system of roping an elevator cab which does not involve the use of overhead sheaves which are directly over the roof of the cab. The elevator is a linear motor elevator which is powered by a linear motor mounted on the counterweight of the elevator assembly. The ropes are fastened to opposite sides of the counterweight, and are fastened to the cab at opposite ends of a beam mounted on the cab frame above the roof of the cab. The ends of the beam lie outside the side walls of the cab in the hoistway, whereby the path of travel of the ropes is outside of the cab side walls. The beam is positioned skew to the transverse vertical plane of symmetry of the cab, whereby the beam passes through the center of gravity axis of the cab, with one of its outer ends being fore, and the other of its outer ends being aft of the aforesaid plane of symmetry. The path of the lateral cab guide rails in the hoistway is thus free of contact with the ropes. The overhead sheaves, which are guide sheaves for the ropes, are positioned on opposite sides of the side walls of the cab, offset from the roof of the cab. There are two pairs of overhead sheaves, one pair on each side of the cab. One cab sheave, i.e. the sheave over which the cab rope passes is aft of one cab guide rail, and the other is mounted so as to rotate about an axis which is coplanar with the other cab guide rail. The rope beam may be articulated on top of the cab so as to automatically adjust rope tension between the sets of ropes connecting the cab and counterweight. The sheaves are thus laterally offset from the cab roof, and the sides of the hoistway are used for rope travel without interfering with the cab guide rails.

It is therefore an object of this invention to provide an elevator roping system wherein the overhead sheaves in the hoistway are laterally offset from the cab roof.

It is a further object of this invention to provide a roping system of the character described wherein the ropes are connected to the cab via a beam the ends of which are outboard of the cab side walls.

It is yet another object of this invention to provide a roping system of the character described wherein the overhead sheaves are positioned so as to keep the ropes away from the cab guide rails.

It is an additional object of this invention to provide a roping system of the character described wherein the beam may be articulated to the cab to provide automatic tension compensation for the ropes.

These and other objects and advantages of the roping system of this invention will become more readily apparent to those skilled in the art from the following detailed description of a preferred embodiment thereof when taken in conjunction with the accompanying drawings, in which:

BEST MODE FOR CARRYING OUT THE INVENTION

Figure 1:
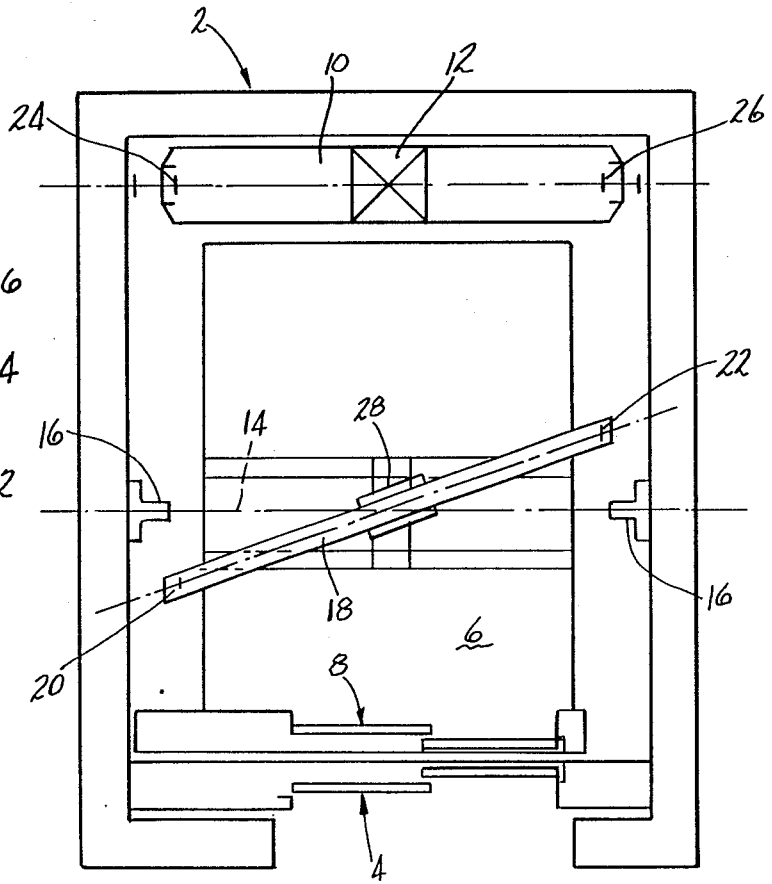
FIG. 1 is a plan view of the top of the elevator system looking down through the hoistway at the top of the cab and counterweight.

Referring now to the drawings, there is shown in FIG. 1 a somewhat schematic view of the hoistway, cab and counterweight utilizing the roping system of the invention. The hoistway is designed generally by the numeral 2, the hall doors by the numeral 4, the cab by the numeral 6, and the cab doors by the numeral 8. The counterweight 10 which carries a linear motor 12 supplying motive power for the elevator is mounted to move up and down on a pole 11 (see FIG 2) in the hoistway 2 against the wall thereof furthest from the hall doors 4. The phantom line 14 designates the transverse plane of symmetry of the cab 6 which contains the center of gravity of the cab 2. Guide rails 16 are mounted on the side walls of the hoistway 2 in the symmetry plane 14 for guiding movement of the cab 6 in the hoistway 2. A beam 18 is mounted on or above the roof of the cab 6 and is positioned thereon so as to be skew with respect to the symmetry plane 14. One end 20 of the beam 18 lies to one side of the symmetry plane 16 and provides means for attaching the left hand rope array to the cab 6, while the other end 22 of the beam 18 lies to the opposite side of the symmetry plane 14 and provides means for attaching the right hand rope array to the cab 6. The left hand rope array is attached to the counterweight 10 at 24, and the right hand rope array is attached to the counterweight 10 at 26. The beam 18 is fixed to the cab 6 by means of a bracket 28 or the like, and the beam 18 can be articulated on the bracket 28 if desired to provide for automatic tension adjustment of the ropes.

Figure 2:
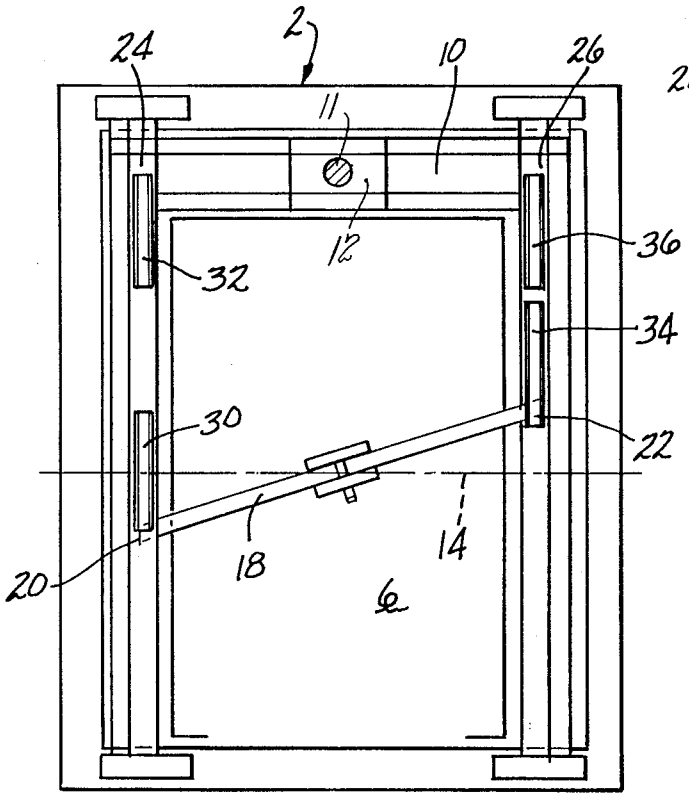
FIG. 2 is a view similar to FIG. 1 but showing the placement of the overhead sheaves in the hoistway.
Figure 3:
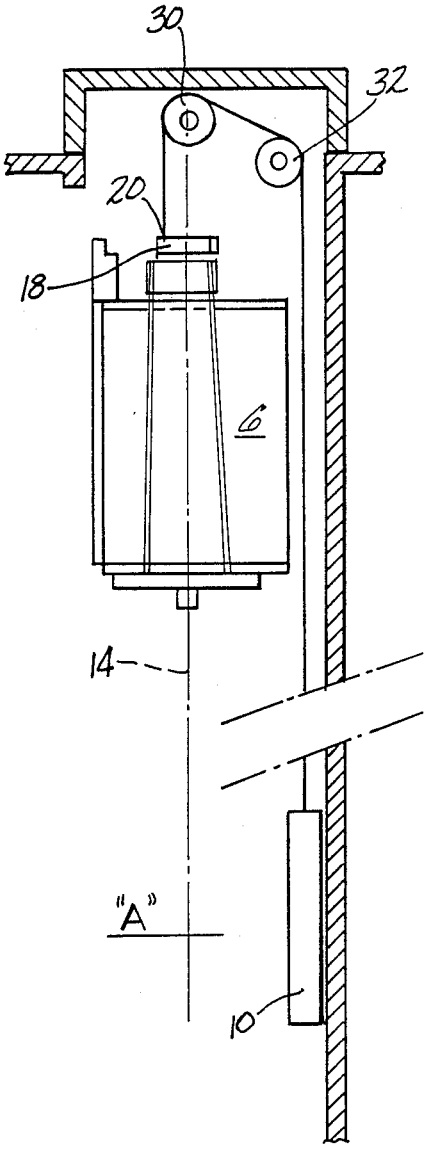
FIG. 3 is a side elevational view of the hoistway, cab and counterweight looking from right to left in FIG. 2.

FIG. 2 shows the positioning of the left and right hand sheave pairs in the hoistway 2. On the left hand side, sheaves 30 and 32 are mounted overhead in the hoistway 2, with the sheave 30 guiding the rope array directly upwardly from the beam end 20, feeding the rope array over the left hand cab guide rail to the sheave 32 from whence the ropes are fed directly down onto the counterweight attachment point 24. The left hand ropes thus pass over the left side cab guide rail without interfering with the cab's engagement therewith, as shown in FIG. 3.

Figure 4:
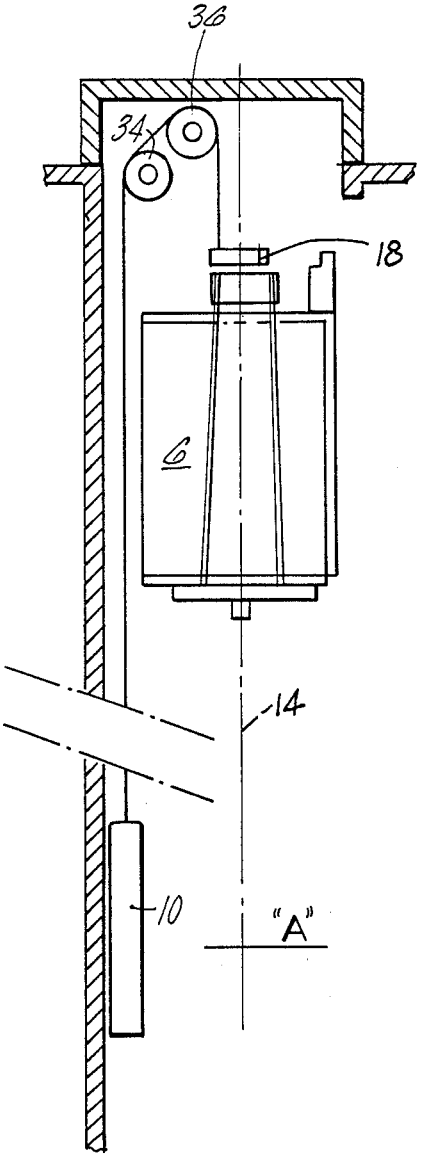
FIG. 4 is a view similar to FIG. 3 but looking from left to right in FIG. 2.

On the right hand side of the hoistway 2, sheave 34 takes the right hand rope array directly up from the beam end 22 and feeds it over to the second sheave 36 from whence it goes directly down to the end 26 of the counterweight 10. The sheave 34 is mounted on the right hand side of the hoistway to the rear of the symmetry plane 14. The right hand rope array is thus fed from the cab 6 to the counterweight 10 in a spatial envelope rearwardly offset from the symmetry plane 14, whereby the right hand rope array does not interfere with engagement of the cab 6 with the right hand cab guide rail, as shown in FIG. 4.

It will be readily appreciated that the roping system of this invention is uncomplicated, and uses a minimum of rope. The sheaves are mounted overhead in the hoistway, but are not directly over the cab roof. The ropes are arranged in left and right hand arrays which interconnect the cab and counterweight without interfering with engagement between the cab and its hoistway guide rails. The use of the skew cab beam allows the sheaves to take up rope from the cab fore and aft of the cab guide rails, while allowing the beam to be connected to the cab along its central axis of symmetry, or center of gravity. The cab beam may be articulated to the cab, if so desired, to provide automatic tension adjustment to the rope arrays.

Since many changes and variations of the disclosed embodiment of the invention may be made without departing from the inventive concept, it is not intended to limit the invention otherwise than as required by the appended claims.

What is claimed is:

1. An elevator assembly mounted in a hoistway, said assembly including a car with side walls and a door; a counterweight; ropes interconnecting the car and counterweight; and a linear motor mounted on one of the car and counterweight for providing motive power for the assembly; first and second sheave sets mounted in an upper end of the hoistway, and the first and second sheave sets consist of all of the sheaves mounted in the upper end of the hoistway each one of said sheave sets being mounted on each respective side of the car whereby none of the sheaves directly overlie the roof of the car, said sheave sets engaging said ropes to guide the latter in the hoistway during movement of the car and counterweight in the hoistway; means attached to said car for securing said ropes to said car at points outboard of said side walls of said car, said means for securing defining a first rope securement location outboard of one of said car side walls and located on the car door side of an imaginary vertical plane containing the center of gravity of the car and perpendicular to said car side walls, and said means for securing defining a second rope securement location outboard of the other of said car side walls and located on the side of said imaginary plane away from the car door whereby the ropes travel from the car in the hoistway along fore and aft paths spaced apart from said imaginary plane.

2. The elevator assembly of claim 1 wherein said ropes are attached to said counterweight at opposite ends of the latter.

3. The elevator assembly of claim 2 wherein said means attached to said car for securing said ropes comprises a beam secured to said car and disposed skew to said imaginary plane with one end of said beam being disposed outwardly of a side wall of said car on the side of said imaginary plane away from said counterweight, and the other end of said beam being disposed outwardly of the opposite side wall of said car on the side of said imaginary plane toward said counterweight.

4. The elevator assembly of claim 3 wherein said beam is secured to said car at a location aligned with the center of gravity of said car.

5. The elevator assembly of claim 4 wherein said beam is secured to said car by a pivot joint operable to provide automatic rope tension adjustment of said ropes.

6. An elevator assembly mounted in a hoistway, said assembly including a car having side walls and a door and a roof; a beam disposed above said car roof and connected to said car at a location vertically aligned with the center of gravity of said car, said beam having opposite ends thereof which are disposed outwardly of the side walls of said car; a counterweight in said hoistway adjacent to said car; ropes connected to said opposite ends of said beam and to said counterweight; a linear motor mounted on said counterweight to provide motive power for said car and counterweight; a first pair of guide sheaves mounted in said hoistway above said car roof and outwardly offset from one of said car side walls, one of said sheaves in said first pair being positioned to guide one of said ropes directly upwardly from one end of said beam, and the other of said sheaves in said first pair being positioned to receive said one rope from said one of said sheaves and guide said one rope directly downwardly onto one end of said counterweight; and a second pair of guide shaves mounted in said hoistway above said car roof and outwardly offset from the opposite one of said car side walls, one of said second pair of guide sheaves being positioned to guide another of said ropes directly upwardly from the opposite end of said beam, and the other of said second pair of guide sheaves being positioned to receive sasid other rope from said one of said second pair of guide sheaves and guide said other rope directly downwardly onto the other end of said counterweight, whereby the sheaves and ropes are disposed in areas of the hoistway which do not directly overlie the car roof.

7. The elevator assembly of claim 6 wherein said beam is mounted in a skew position on said car so that one end of said beam lies on the door side of an imaginary transverse vertical plane of symmetry of said car which contains the center of gravity of said car, and the opposite end of said beam lies on the counterweight side of said imaginary plane.

8. The elevator assembly of claim 7 further including car guide rails mounted in the hoistway in said imaginary plane.

9. The elevator assembly of claim 7 wherein said beam is pivotally mounted on said car for providing automatic rope tension adjustment.

* * * * *

UNITED STATES PATENT AND TRADEMARK OFFICE

CERTIFICATE OF CORRECTION

PATENT NO. : 4,949,815

DATED : August 21, 1990

INVENTOR(S) : Marcel Pavoz

It is certified that error appears in the above-identified patent and that said Letters Patent is hereby corrected as shown below:

Col. 1, line 11, "larly." should read --larly,--.

Col. 2, line 49, "FIG 2" should read --FIG. 2--.

Col. 3, line 54, "hoistway" should read --hoistway;--.

Col. 4, line 49, "sasid" should read --said--.

Signed and Sealed this

Third Day of March, 1992

*Attest:*

HARRY F. MANBECK, JR.

*Attesting Officer*

*Commissioner of Patents and Trademarks*